US010662659B2

(12) United States Patent
Bacon et al.

(10) Patent No.: US 10,662,659 B2
(45) Date of Patent: May 26, 2020

(54) METHOD AND SYSTEM TO SECURE SHORING DECK TO A COLUMN

(71) Applicant: Titan Formwork Systems, LLC, Tempe, AZ (US)

(72) Inventors: David L. Bacon, Tempe, AZ (US); D. Randall Shilling, Tempe, AZ (US); Kameron M. Abt, Phoenix, AZ (US)

(73) Assignee: TITAN FORMWORK SYSTEMS, LLC, Tempe, AZ (US)

( * ) Notice: Subject to any disclaimer, the term of this patent is extended or adjusted under 35 U.S.C. 154(b) by 25 days.

(21) Appl. No.: 16/158,990

(22) Filed: Oct. 12, 2018

(65) Prior Publication Data

US 2020/0024856 A1 Jan. 23, 2020

Related U.S. Application Data

(60) Provisional application No. 62/702,087, filed on Jul. 23, 2018.

(51) Int. Cl.
*E04G 11/50* (2006.01)
*E04G 11/38* (2006.01)

(52) U.S. Cl.
CPC ..... *E04G 11/50* (2013.01); *E04G 11/38* (2013.01); *E04G 2011/505* (2013.01)

(58) Field of Classification Search
CPC ..... E04G 11/36; E04G 11/38; E04G 11/48; E04G 11/50
See application file for complete search history.

(56) References Cited

U.S. PATENT DOCUMENTS 2,986,183 A * 5/1961 Jackman ..... E04G 13/04 269/91
3,034,162 A 5/1962 Smith
(Continued)

FOREIGN PATENT DOCUMENTS

CN 2016696067 U 1/2011
EP 3 073 028 A1 9/2016
(Continued)

OTHER PUBLICATIONS

"ToolPro 4 ft. to 11 ft. Adjustable Lag Pole—TP05220", The Home Depot, printed from the internet at < https://www.homedepot.com/p/ToolPro-4-ft-to-11-ft-Adjustable-Lag-Pole-TP05220/206777767?MERCH=REC-_-PIPHorizontal2_rr-_-206777768-_-206777767-_-N>, on Jul. 31, 2019, 2 pages.
(Continued)

*Primary Examiner* — Michael Safavi
(74) *Attorney, Agent, or Firm* — Brinks Gilson & Lione

(57) ABSTRACT

The disclosure is directed to a method and system for securing a shoring deck to a column. The method includes providing a first beam bracing against a column, wherein the first beam is disposed at a first longitudinal axis that is perpendicular to a long axis of the column. The method includes coupling the first beam to first and second deck beams of a plurality of deck beams of a shoring deck. The method also includes providing a second beam bracing against the column and coupling the second beam to third and fourth deck beams of the plurality of deck beams. The method further includes positioning the first and second beams with respect to the column such that respective first and second longitudinal axes through the respective first and second beams are aligned at an acute angle with respect to each other.

31 Claims, 10 Drawing Sheets

(56) References Cited

U.S. PATENT DOCUMENTS

| | | | | |
|---|---|---|---|---|
| 3,376,011 | A | 4/1968 | Petchuk | |
| 3,504,879 | A * | 4/1970 | Strickland | E04G 17/16 248/296.1 |
| 3,843,084 | A * | 10/1974 | Gregory | E04G 17/16 248/295.11 |
| 4,105,239 | A | 8/1978 | Akczinski, Sr. | |
| 5,063,652 | A | 11/1991 | Roberge | |
| 5,390,464 | A * | 2/1995 | West | E04B 5/43 52/741.1 |
| 6,604,766 | B2 | 8/2003 | Hassell | |
| 7,588,537 | B2 | 9/2009 | Bass | |
| 7,883,296 | B2 | 2/2011 | Meyer | |
| 8,065,938 | B1 | 11/2011 | Kravitch | |
| 8,100,378 | B1 * | 1/2012 | Casini | E04B 5/38 108/158.11 |
| 8,516,762 | B1 | 8/2013 | Jendusa | |
| 8,656,543 | B2 | 2/2014 | Porter et al. | |
| 9,004,443 | B2 | 4/2015 | Zhang | |
| 9,175,472 | B1 | 11/2015 | Calini | |
| 9,469,025 | B1 | 10/2016 | Ostrobrod | |
| 2002/0152704 | A1 | 10/2002 | Thompson et al. | |
| 2012/0042495 | A1 | 2/2012 | Bacon | |
| 2014/0270920 | A1 | 9/2014 | Bacon | |
| 2017/0022726 | A1 * | 1/2017 | Sun | E04H 1/04 |
| 2017/0334058 | A1 | 11/2017 | Koch et al. | |
| 2019/0010717 | A1 | 1/2019 | Baron et al. | |
| 2019/0145115 | A1 | 5/2019 | Bacon et al. | |

FOREIGN PATENT DOCUMENTS

| | | | | |
|---|---|---|---|---|
| FR | 1547697 | A * | 11/1968 | E04G 25/06 |
| GB | 2535024 | A | 8/2016 | |
| JP | 6306946 | B2 | 4/2018 | |
| WO | WO 95/00727 | A1 | 1/1995 | |

OTHER PUBLICATIONS

"Telescopic Pole—7-18' H-6056", Uline, printed from the internet at <https://www.uline.com/Product/Detail/H-6056/Mops-Squeegees-and-Carts/Telescopic-Pole-7-18?pricode=WA9164&gadtype=pla&id=H-6056&gclid=EAIaIQobChMI1PDk8P_c4wIVA_7jBx3gAQVvEAQYASABEgIJYvD_BwE&gclsrc=aw.ds>, on Jul. 31, 2019, 1 page.

"3M DBI-SALA Extendable Pole Hoist—9WHY0|8510409", Grainger, printed from the internet at <https://www.grainger.com/product/9WHY0?gclid=EAIaIQobChMIg4GrP_c4wIVjP7jBx0oBgaqEAQYAiABEgKa8vD_BwE&cm_mmc=PPC:+Google+PLA&ef_id=EAIaIQobChMIg4GrP_c4wIVjP7jBx0oBgaqEAQYAiABEgKa8vD_BwE:G:s&s_kwcid=AL!2966!3!281733071162!!!g!537665576366!>, on Jul. 31, 2019, 3 page.

* cited by examiner

METHOD AND SYSTEM TO SECURE SHORING DECK TO A COLUMN

CROSS-REFERENCE TO RELATED APPLICATIONS

This application claims priority from U.S. Provisional Application No. 62/702,087, filed Jul. 23, 2018, the entirety of which is hereby fully incorporated by reference herein.

BACKGROUND

1. Technical Field

The present disclosure relates to a method and a system to secure a shoring deck that is used to support a load, such as to support forms for poured concrete construction. In particular, the present disclosure relates to a method and a system using one or more beams in an asymmetric configuration to secure a shoring deck to a column, such as to provide lateral support for the shoring deck.

2. Background Information

A shoring deck or shoring tower may be used for bearing heavy loads during construction, such as when pouring concrete for concrete building construction. Therefore, the stability of the shoring deck is critical for safety and quality of the finished work. However, there lacks a convenient and effective method to secure the shoring deck that supports the shoring deck based upon expected vertical loads as well as expected lateral loads. Often, engineered shoring systems rely upon cross-bracing between adjacent vertical shoring posts, which, especially for shoring systems that hold shoring beams high above the floor, may be time consuming and expensive to erect, as well as may establish barriers within the construction zone which add complications to working in the environment below the erected shoring deck.

The present disclosure is directed toward addressing one or more drawbacks, including but not limited to those set forth above.

BRIEF SUMMARY

The present disclosure is directed to a method for securing a shoring deck with a plurality of deck beams to a column. The method includes providing a first beam bracing against a column, wherein the first beam in some embodiments is disposed at a first longitudinal axis that is perpendicular to an axis of the column. The method includes coupling the first beam to a first deck beam of a plurality of deck beams of a shoring deck and a second deck beam of the plurality of deck beams of the shoring deck. The method also includes providing a second beam bracing against the column. The method includes coupling the second beam to a third deck beam of the plurality of deck beams of the shoring deck and a fourth deck beam of the plurality of deck beams of the shoring deck. The method further includes positioning the first and second beams with respect to the column such that respective first and second longitudinal axes through the respective first and second beams are aligned at an acute angle with respect to each other.

The present disclosure is also directed to a method for securing a shoring deck to a column. The method includes positioning a first beam in contact with a first side surface of a column and coupling the first beam to a first deck beam of a shoring deck and a second deck beam of the shoring deck.

The method also includes positioning a second beam in contact with a second side surface of the column and coupling the second beam to a third deck beam of the shoring deck and a fourth deck beam of the shoring deck. The method further includes positioning the first and second beams with respect to the column such that respective first and second longitudinal axes through the respective first and second beams are aligned at an acute angle with respect to each other.

The present disclosure also describes a system with a first beam and a second beam for securing a shoring deck to a column. The first beam is provided to brace against the column and in some embodiments is perpendicular to a longitudinal axis of the column. The first beam is coupled to a first deck beam and a second deck beam of the shoring deck. The second beam is provided to brace against the column. The first and second beams are disposed with respect to the column such that respective first and second longitudinal axes through the respective first and second beams are aligned at an acute angle with respect to each other.

One advantage of the present disclosure is that lateral movement of the shoring deck is restricted and the stability of the shoring deck is greatly improved.

DETAILED DESCRIPTION OF THE DRAWINGS

Figure 1:
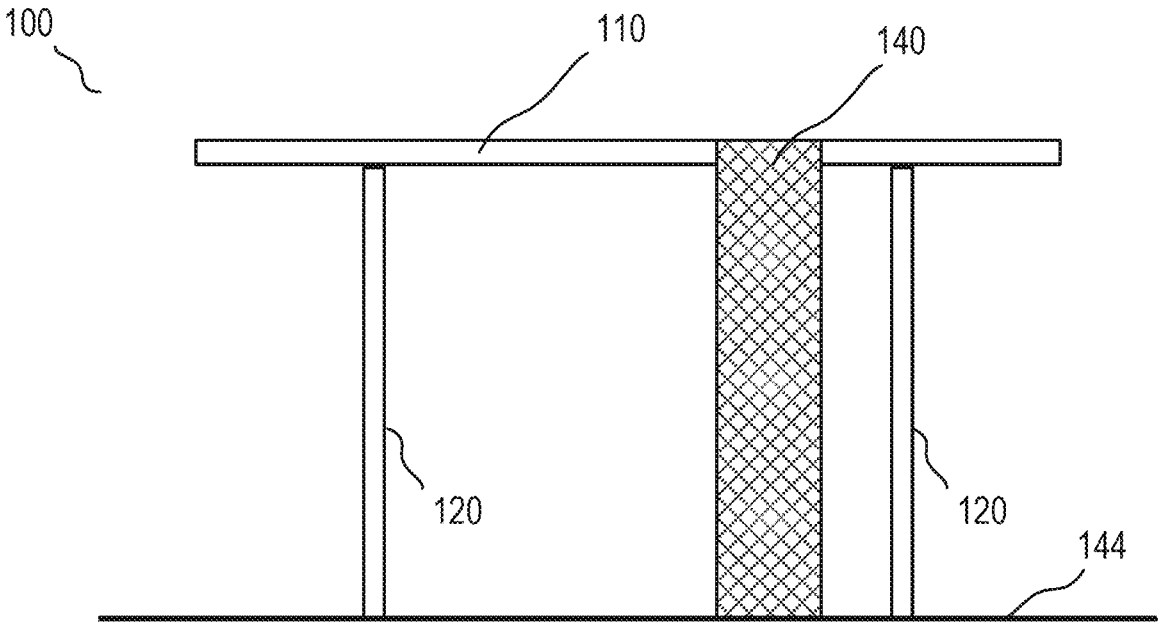
FIG. 1 is a schematic diagram of a shoring deck and a column.

The invention will now be described in detail hereinafter with reference to the accompanied drawings, which form a part of the present invention, and which show, by way of illustration, specific examples of embodiments. Please note that the invention may, however, be embodied in a variety of different forms and, therefore, the covered or claimed subject matter is intended to be construed as not being limited to any of the embodiments to be set forth below. Please also note that the invention may be embodied as methods, devices, components, or systems. Accordingly, embodiments of the invention may, for example, take the form of hardware, software, firmware or any combination thereof.

Throughout the specification and claims, terms may have nuanced meanings suggested or implied in context beyond an explicitly stated meaning. Likewise, the phrase "in one embodiment" or "in some embodiments" as used herein does not necessarily refer to the same embodiment and the phrase "in another embodiment" or "in other embodiments" as used herein does not necessarily refer to a different embodiment. It is intended, for example, that claimed subject matter includes combinations of exemplary embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" or "at least one" as used herein, depending at least in part upon context, may be used to describe any feature, structure, or characteristic in a singular sense or may be used to describe combinations of features, structures or characteristics in a plural sense. Similarly, terms, such as "a", "an", or "the", again, may be understood to convey a singular usage or to convey a plural usage, depending at least in part upon context. In addition, the term "based on" or "determined by" may be understood as not necessarily intended to convey an exclusive set of factors and may, instead, allow for existence of additional factors not necessarily expressly described, again, depending at least in part on context.

Poured concrete construction techniques require a shoring deck be established to support the contrete, rebar, and other materials during the concrete pouring and during the time the poured concrete cures before the pured concrete is strong enough to support itself. A shoring deck normally includes a plurality of horizontal beams (or at other orientations when the desired final surface isn't horizontal) that is supported by a network of shoring posts that carry the horizontal beams. When a shoring deck is contructed, such as for poured concrete building construction, the shoring deck may be established a large distance above an existing floor (such as either the ground or a poured concrete surface that was previously constructed). For example, the shoring deck may be 9 feet above the floor level, or much higher such as 15, 20, 23, 25 feet above the established floor level or other heights as called for by building plans. The shoring deck is constructed to support a heavy load. The heavy load may include the weight of the poured concrete surface (including concrete, rebar and other engineered materials/structures), the forms for supporting the concrete during the curing process, construction equipment, workers, elements such as wind, rain, snow, etc. The shoring deck must not only be engineered to support the potential loads that it will encounter during pouring and curing of the concrete construction, but it must also be capable of supporting the maximum potential lateral loads with at least a minimum factor of safety required by building codes and proper construction practices. The present disclosure describes a method and system to secure the shoring deck to support potential lateral loads.

As shown in FIG. 1, the present disclosure describes a method and a system 100 to secure a shoring deck 110 to a vertical column 140 in order to allow the column to support the shoring deck against lateral loads. The column 140 may be a steel column, or a concrete column, or a column made of other construction materials. The column 140 may have a same height as the shoring deck 110. In other embodiment, the column 140 may be higher than the shoring deck 110. The shoring deck 110 is supported by a number of shoring posts 120 above a floor 144.

Figure 2:
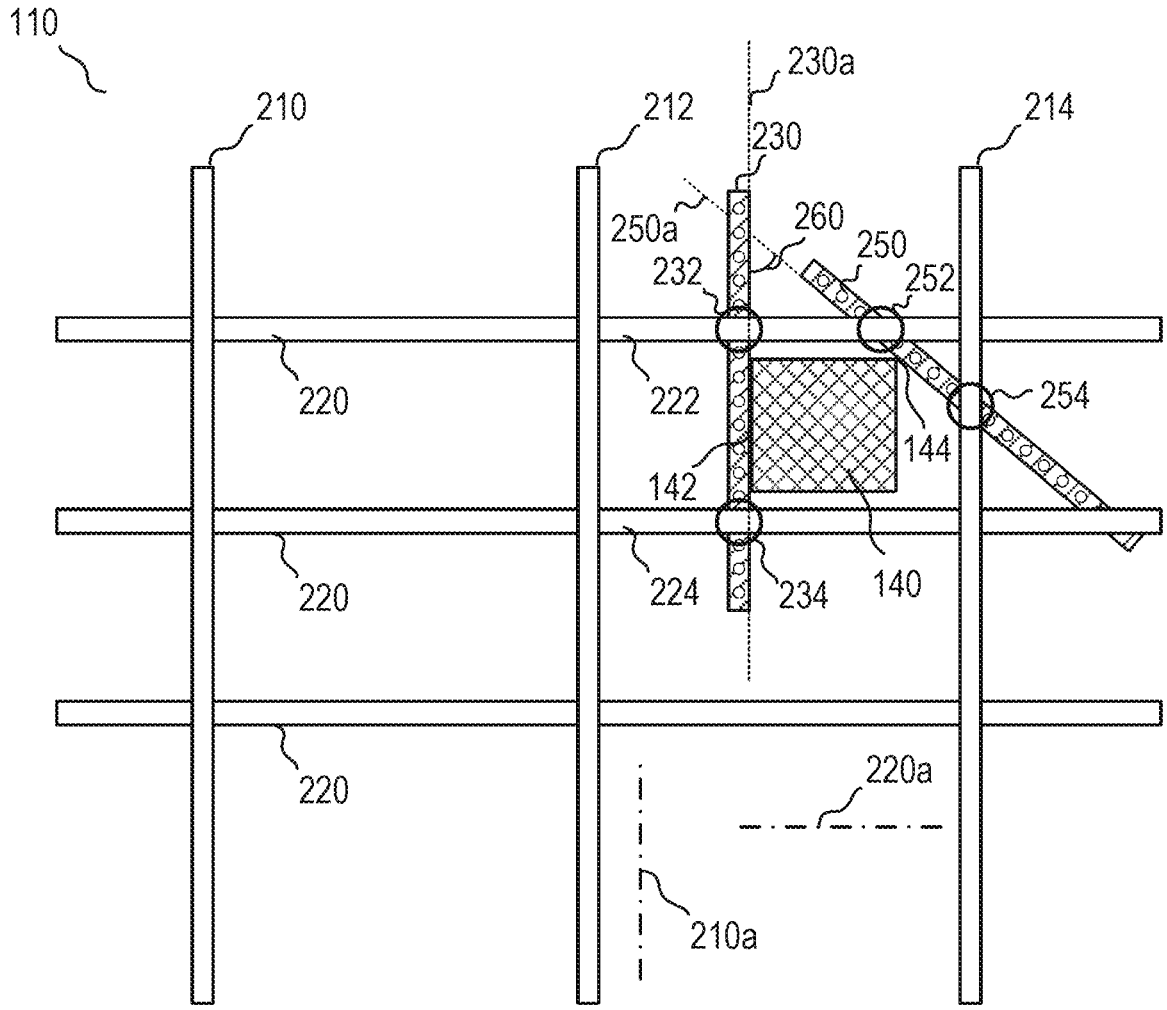
FIG. 2 is a schematic diagram of an embodiment of securing a shoring deck to a column.

As shown in FIG. 2, a shoring deck 110 may include a number of deck beams. The deck beams may be arranged in a pattern and include primary deck beams 210 and/or secondary deck beams 220. The primary deck beams 210 are coupled to the secondary deck beams 220. In some embodiments, the primary deck beams 210 may be perpendicular to the secondary deck beams 220. In some embodiments, the primary and secondary deck beams are disposed at the same height, such that the collective top surfaces extend along the same plane, while in other embodiments, the secondary deck beams rest above the primary deck beams or vice versa.

A column 140 may be surrounded by multiple deck beams such as four deck beams in grid. In an exemplary embodiment depicted in FIG. 2, the column 140 may be surrounded by two primary deck beams 212 and 214 and two secondary deck beams 222 and 224. A first beam 230 is provided to brace against a first side surface 142 of the column 140, which in the embodiment shown in FIG. 2 is a planar wall surface, but in other embodiments could be an edge of the column, or an arcuate surface of a column (such as when a column is cylindrical or elliptical or curved in other shapes) or in multiple separated points or surfaces of a column, so that the first beam provides lateral support and motion restriction to the shoring deck relative to the column 140. For example, as shown in FIG. 2, the first beam 230 may stabilize and secure the shoring deck by restricting lateral movement along a long axis 220*a* of the secondary deck beams 220 (depicted in FIG. 2 as parallel to deck beam 220 for clarity, but the long axis 220*a* actually extends through the deck beam 220). The first beam 230 may be coupled to one secondary deck beam 222 with a coupling device 232, and the first beam may also be coupled to another secondary deck beam 224 via a coupling device 234.

As FIG. 2 shows, a second beam 250 may be provided to brace against a second side surface 144 of the column 140*m* such as an edge of the column 140 (which may form a corner of the column), so that the second beam 250 provides lateral support and motion restriction to the shoring deck relative to the column 140. Depending upon the cross-section of the column 140, the second beam 250 may contact a curved surface, multiple edges, or the other geometrical features of the column 140. For example, as shown in FIG. 2, the second beam 250 may stabilize and secure the shoring deck by restricting lateral movement along a long axis 220*a* of the secondary deck beam 220, in the opposite direction along long axis 220*a* than the first beam 230 supports and restricting lateral movement along a long axis 210*a* of the primary deck beam 210 (depicted in FIG. 2 as parallel to deck beam 210 for clarity, but the long axis 210*a* actually extends through the deck beam 210). The second beam 250 may be coupled to one secondary deck beam 222 with a coupling device 252, and the second beam 250 may also be coupled to one primary deck beam 214 with a coupling device 252.

The second beam 250 may be positioned with respect to the first beam 230, such that the longitudinal axes (230*a*, 250*a*) of the first and second beams 230, 250 are disposed at an angle 260 with respect to each other. The angle 260 may be an angle between 10 and 80 degrees (inclusive of the bounds of the range), or between 15 to 75 degrees (inclusive of the bounds of the range), or between 30 and 60 degrees (inclusive of the bounds of the range), or in some embodiments, at an angle of about 25, 30, 35, 40, 45, 50, 55, 60, 65, 70, 75 or 80 degrees. The term "about" is specifically defined herein (when referencing an angle) to mean the value listed plus or minus 2 degrees of the value. As shown in FIG. 2, the acute angle 260 is about 45 degrees.

In some embodiments, as depicted in FIG. 2, the secondary beams 220 support the primary deck beams 210, 212, 214 such that the primary deck beams rest upon the secondary beams. In other embodiments, the secondary beams may rest upon the top surfaces of the primary deck beams. In still other embodiments, as depicted in FIG. 7B primary and second beams (shown as 712, 714, 722) may be disposed at the same level. In embodiments with stacked primary and secondary beams, the second 250 may be fixed to one primary and one secondary beam (e.g. connections 252, 254 of FIG. 2), which in some embodiments are disposed at differing heights when stacked. In these embodiments a longitudinal axis 250*a* though the secondary beam may be at an acute angle with respect to floor (i.e. the surface that shoring posts that support the primary and secondary beams rest upon) and may also be at an oblique angle with respect to the longitudinal axis through the column 140 (i.e. an axis going through the drawing sheet that includes FIG. 2). In embodiments where the primary and secondary beams are at the same level, the longitudinal axis 250*a* through the second beam 250 may be perpendicular to the longitudinal axis of the column 140. In the embodiment of FIG. 2, the first beam 230 is connected to two parallel secondary beams at the same height (points 232, 234) and therefore the longitudinal axis 230*a* is perpendicular to the longitudinal axis of the column 140. Of course, the beams 230, 250 may be aligned at different angles with respect to the column based upon the alignment and position of the beams that support the concrete forms based upon the desired geometry of the concrete to be poured.

The first beam 230 may be a metal beam, a wood beam, or a beam made of other materials. For example, the first beam may be a bar, an angle, a rectangular cross-section, or another shape or shapes along its length. The beam may be steel, aluminum, wood, or another material. In some embodiments, the first beam 230 may be an elongate member with two surfaces that are disposed at a substantially perpendicular angle with respect to each other, such as a convention angle iron. In some embodiments the beam may be a wood 2×4. The first beam 230 may include a plurality of pre-punched holes therealong to allow for fasteners to extend therethrough to couple to deck beams via coupling devices. The coupling device 232 and the coupling device 234 may be a same type of coupling devices or different types of coupling device.

The second beam 250 may like the first beam 230 or may be a different structure (including the various structures that could be used as the first beam as described above). The coupling device 232 and the coupling device 234 may be a same type of coupling devices or different types of coupling device. The coupling devices associated with the second beam and the first beam may be the same type or different type of coupling devices. For example, the coupling devices may be T bolts as are known in the art. In other embodiments, a wedge clamp (discussed below) may be used, or other coupling structures or fasteners.

Figure 3:
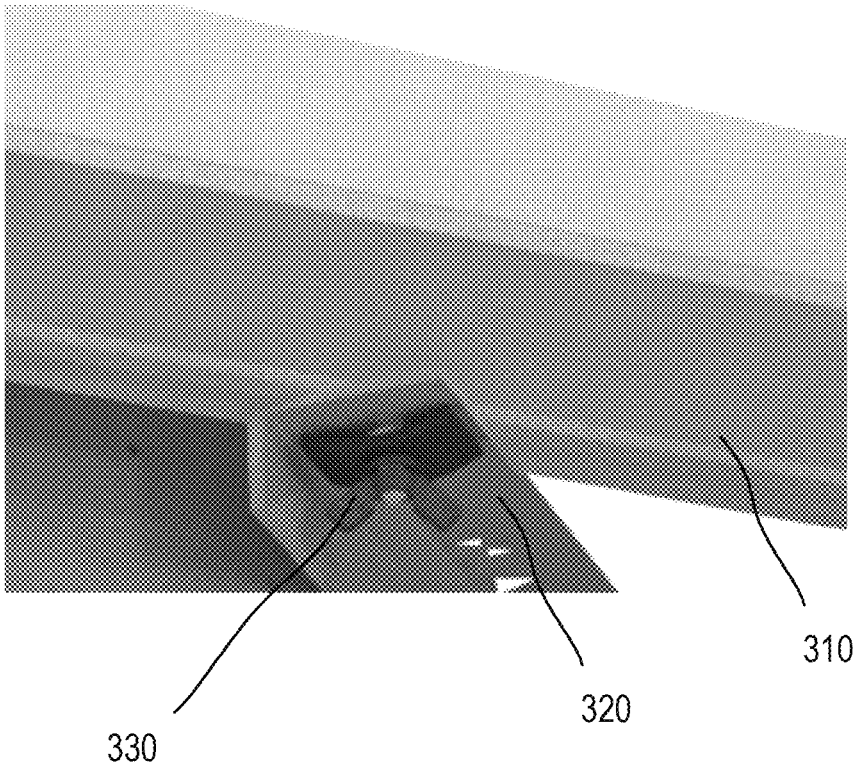
FIG. 3 is a drawing of an embodiment of coupling a beam to a deck beam.

In one embodiment, as shown in FIG. 3, a coupling device 330 may be a bolt. The coupling device 330 couples a beam 320 to a deck beam 310 of a shoring deck. The bolt may be any type of bolts capable of coupling one beam to another beam, for example but not limited to, a butterfly bolt.

Figure 4A:
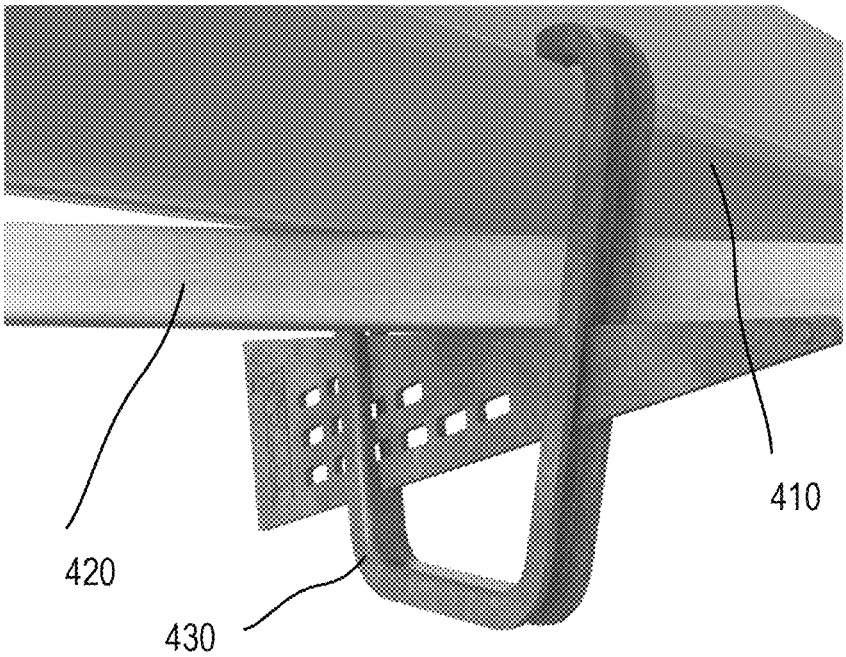
FIG. 4A is a drawing of an embodiment of coupling a beam to a deck beam.
Figure 4B:
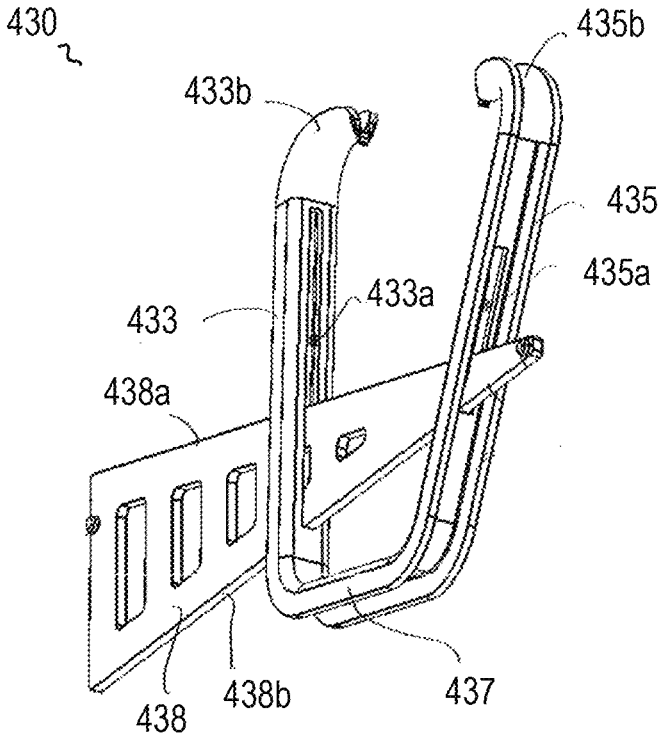
FIG. 4B is a schematic diagram of the coupling device shown in FIG. 4A.

In another embodiment, as shown in FIG. 4A, a coupling device 430 may be a clamp. The coupling device 430 couples a beam 420 to a deck beam 410 of a shoring deck. The clamp may be any type of clamps capable of coupling one beam to another beam, for example but not limited to, a wedge clamp as in FIGS. 4A and 4B. The wedge clamp includes a first arm 433 and a second arm 435. The first arm 433 and the second arm 435 are opposite to each other and are connected by a central member 437. Each of the first and second arms 433, 435 include fingers 433*b*, 435*b* that extend inwardly and are disposed upon the opposite end of the arm that meets or is connected to the central member 437. The extending fingers 433*b*, 435*b* of the first and second arms rest upon a surface of the deck beam 410. The first arm 433 has a first slot 433*a*, and the second arm 435 has a second slot 435*a*. The wedge clamp also includes a wedge 438. The wedge 438 may have a triangle shape as shown in FIGS. 4A and 4B, and my include a top edge 438*a* and a bottom edge 438*b*. The wedge 438 decreases a space between the top edge 438*a* of the wedge 438 and the fingers 433*b*, 435*b*, as the wedge 438 extends further through the first and second slots 433*a*, 435*a*, so as to mechanically couple one beam to another beam.

Figure 5:
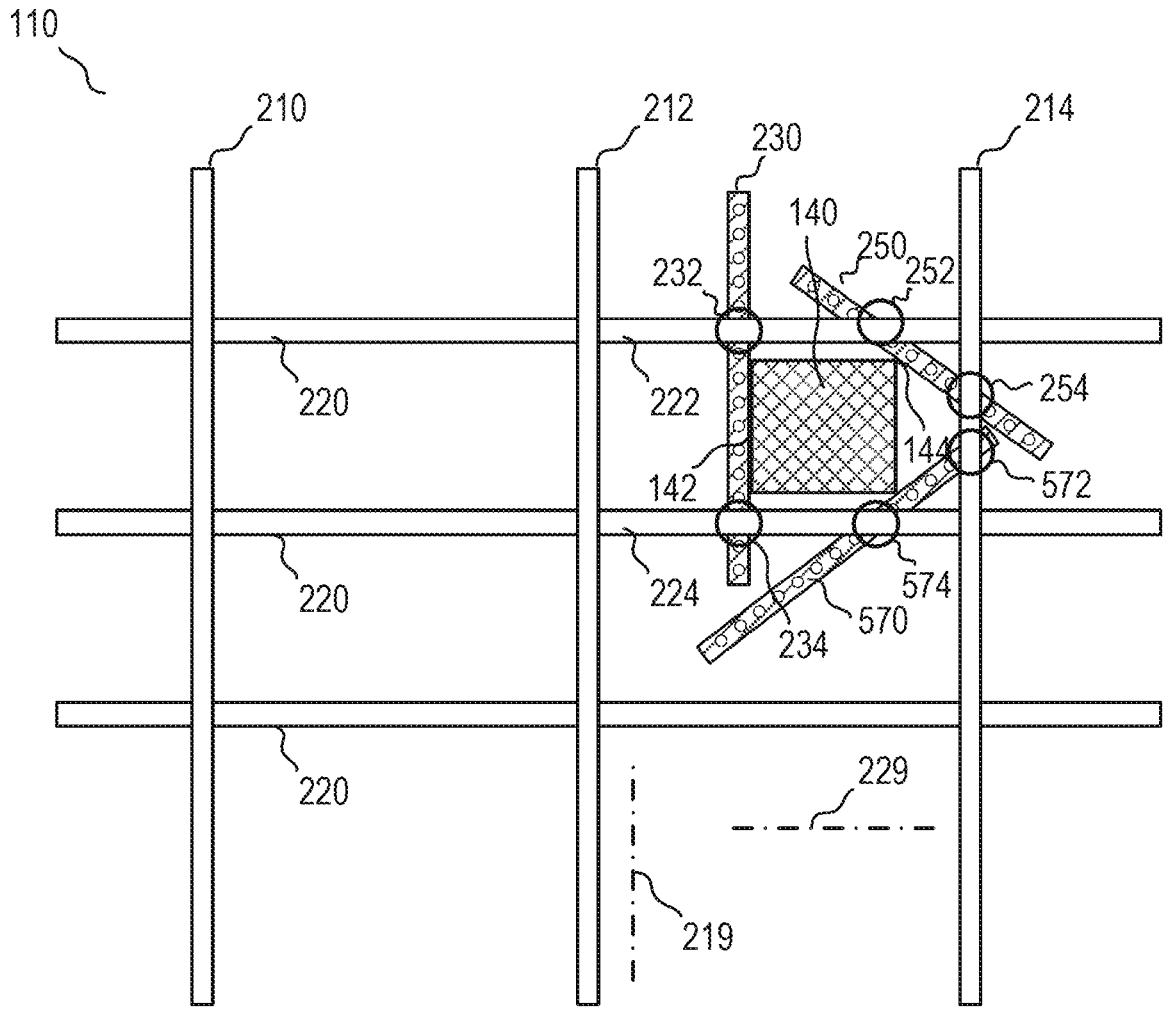
FIG. 5 is a schematic diagram of an embodiment of securing a shoring deck to a column.

In another embodiment, as FIG. 5 shows, a third beam 570 may be provided to brace against another corner of the column 140. The third beam 570 may be coupled to the primary deck beam 214 with a coupling device 572, and the third beam 570 may be coupled to the secondary deck beam 224 with another coupling device 574.

Figure 6:
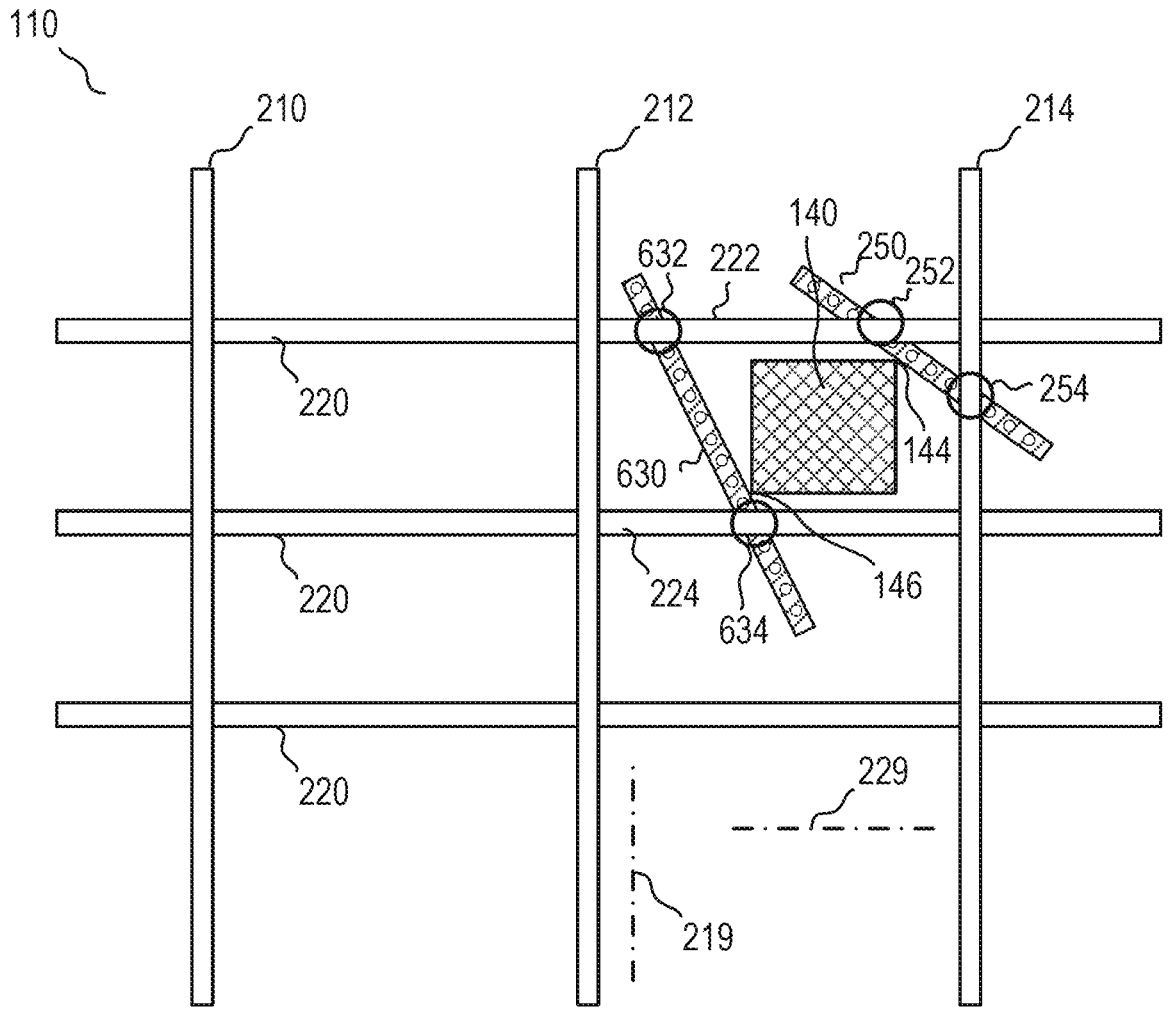
FIG. 6 is a schematic diagram of an embodiment of securing a shoring deck to a column.

FIG. 6 shows another embodiment wherein a first beam 630 and a second beam 250 are in a different configuration in comparison with a system in FIG. 2, a first beam 630 may be provided to brace against a second corner 146 of a column 140. The first beam 630 may be coupled to the secondary deck beam 222 with a coupling device 632, and the third beam 630 may be coupled to the secondary deck beam 224 with another coupling device 574. In another embodiment, an additional beam may be provided to brace against a third corner of the column 140.

Figure 7A:
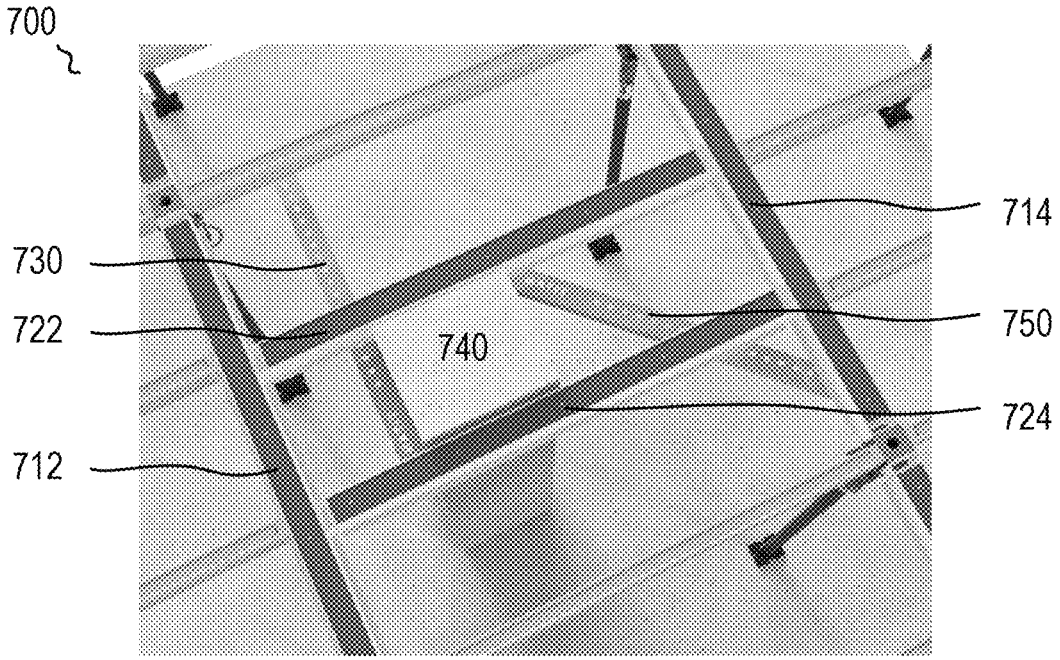
FIG. 7A is a drawing of a top perspective view of an embodiment of securing a shoring deck to a column.
Figure 7B:
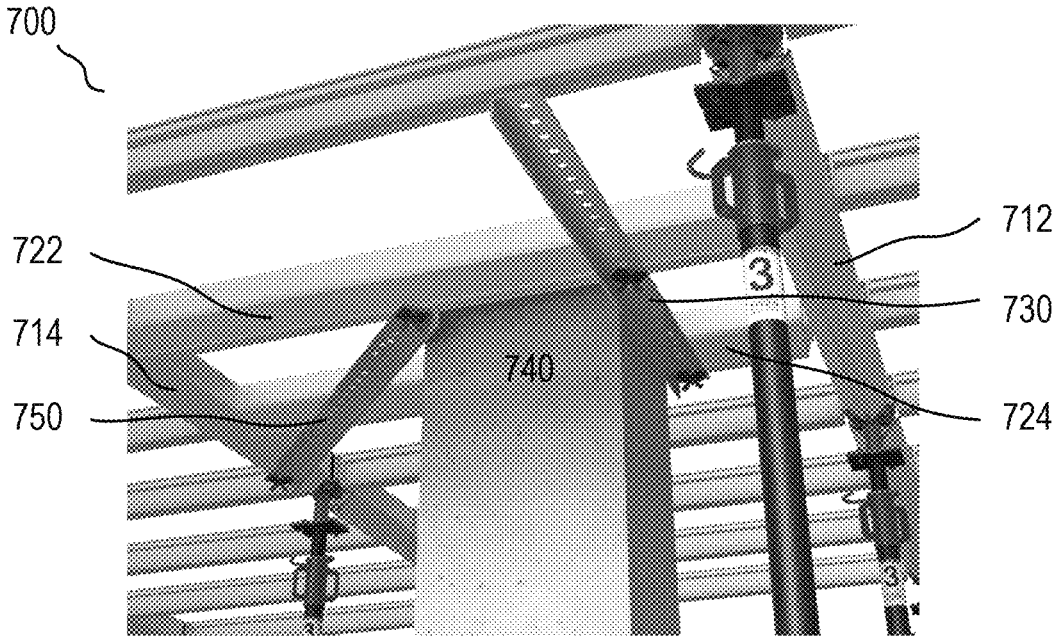
FIG. 7B is a drawing of a bottom perspective view of the embodiment shown in FIG. 7A.

Another embodiment is shown in FIGS. 7A and 7B. A shoring deck 700 is secured to a column 740. A first beam 730 is provided to brace against a side surface of the column 740, and a second beam 750 is provided to brace against a corner of the column 740. The first beam 730 is coupled to a deck beam 722 and a deck beam 724. The second beam 750 is coupled to the deck beam 722 and a deck beam 714. The column 740 is surrounded by deck beams 712, 714, 722, and 724.

Figure 8A:
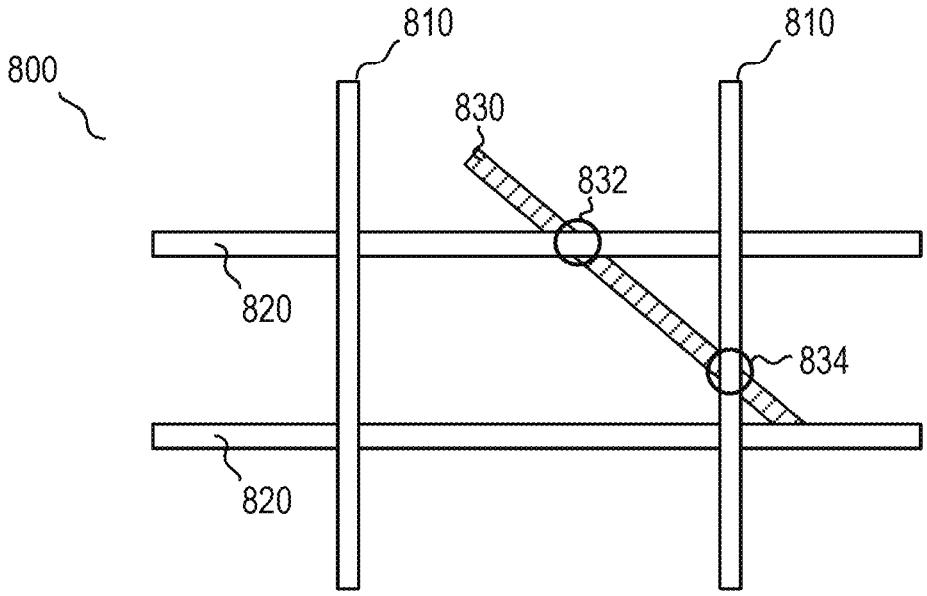
FIG. 8A is a schematic top view of an embodiment of securing a shoring deck.
Figure 8B:
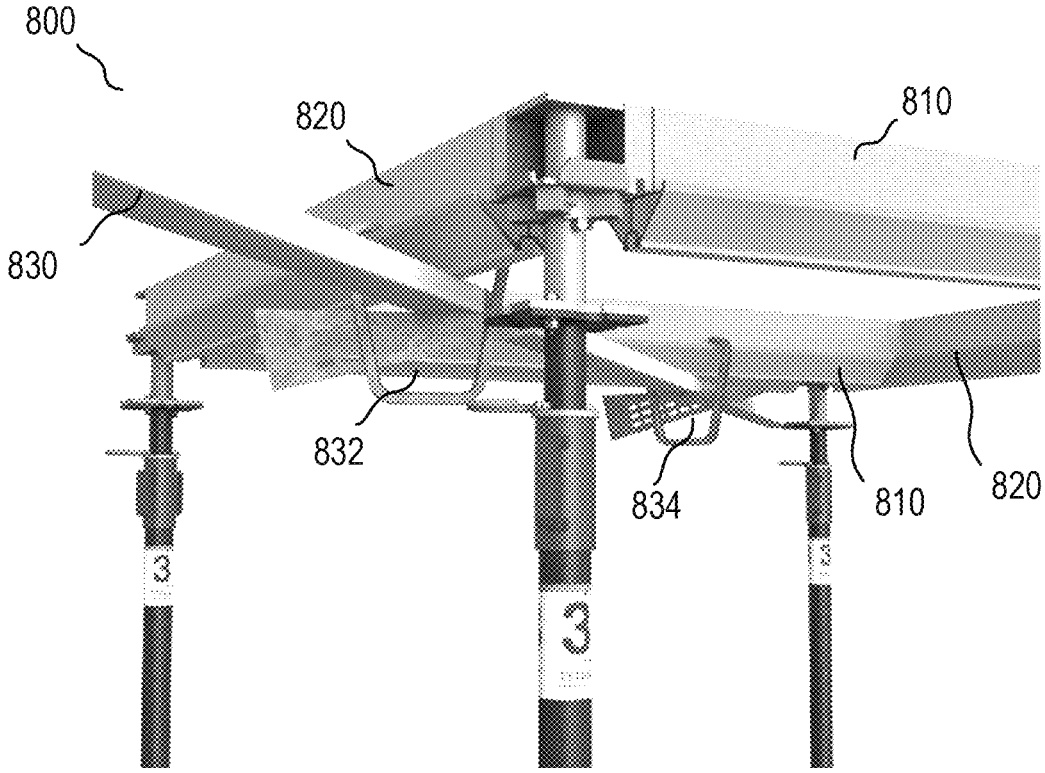
FIG. 8B is another perspective view of the shoring deck of FIG. 8A.

As FIGS. 8A and 8B show, the present disclosure also describes a system 800 to secure a shoring deck with a beam 830. The beam 830 is provided to be at an acute angle between the beam 830 and deck beams 810 and 820, wherein the deck beams 810 are perpendicular to the deck beams 820. The beam 830 is coupled to one of the deck beams 820 with a first coupling device 832; and the beam 830 is coupled to one of the deck beams 810 with a second coupling device 834. For example as FIG. 8B shows, the first coupling device 832 and the second coupling device 834 may be wedge clamps such as those discussed above.

The present disclosure describes a system with a first beam and a second beam for securing a shoring deck to a column. The first beam is provided to brace against the column and be perpendicular to a long axis of the column. The first beam is coupled to a first deck beam and a second deck beam of the shoring deck. The second beam is provided to brace against the column and be perpendicular to the long axis of the column. The second beam is coupled to a third deck beam and a fourth deck beam of the shoring deck. The first beam and the second beam form an acute angle. One advantage of the present disclosure is that lateral movement of the shoring deck is restricted and the stability of the shoring deck is greatly improved.

The present disclosure also describes a method. The method includes using a system for securing a shoring deck. The system may be any of the embodiments as described above.

Figure 9:
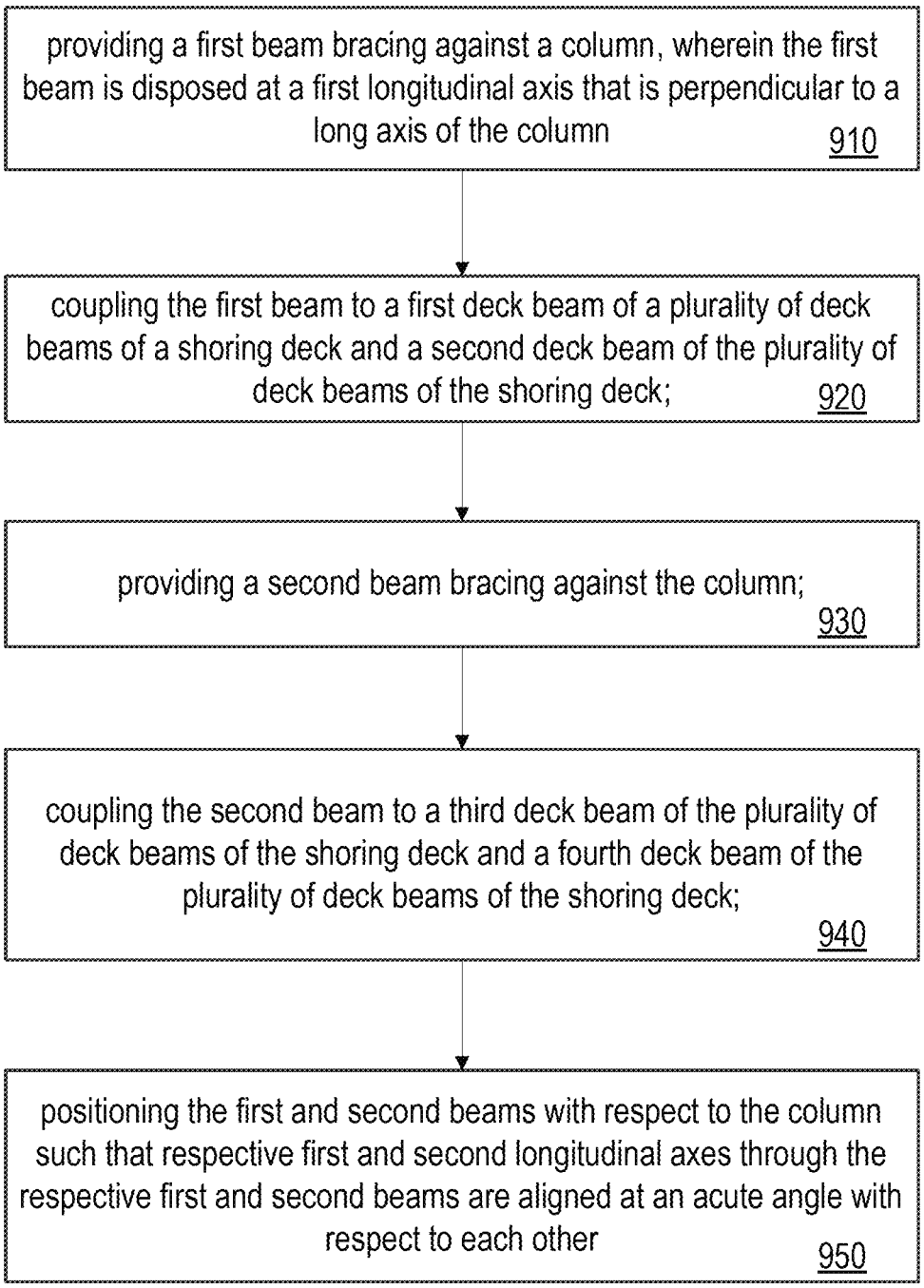
FIG. 9 is a flow diagram of a method for securing a shoring deck to a column.

In one embodiment, a method for securing a shoring deck to a column is shown in FIG. 9. The method includes step 910: providing a first beam bracing against a column, wherein the first beam is disposed at a first longitudinal axis that is perpendicular to a long axis of the column; step 920: coupling the first beam to a first deck beam of a plurality of deck beams of a shoring deck and a second deck beam of the plurality of deck beams of the shoring deck; step 930: providing a second beam bracing against the column; and step 940: coupling the second beam to a third deck beam of the plurality of deck beams of the shoring deck and a fourth deck beam of the plurality of deck beams of the shoring deck; and step 950: positioning the first and second beams with respect to the column such that respective first and second longitudinal axes through the respective first and second beams are aligned at an acute angle with respect to each other.

Figure 10:
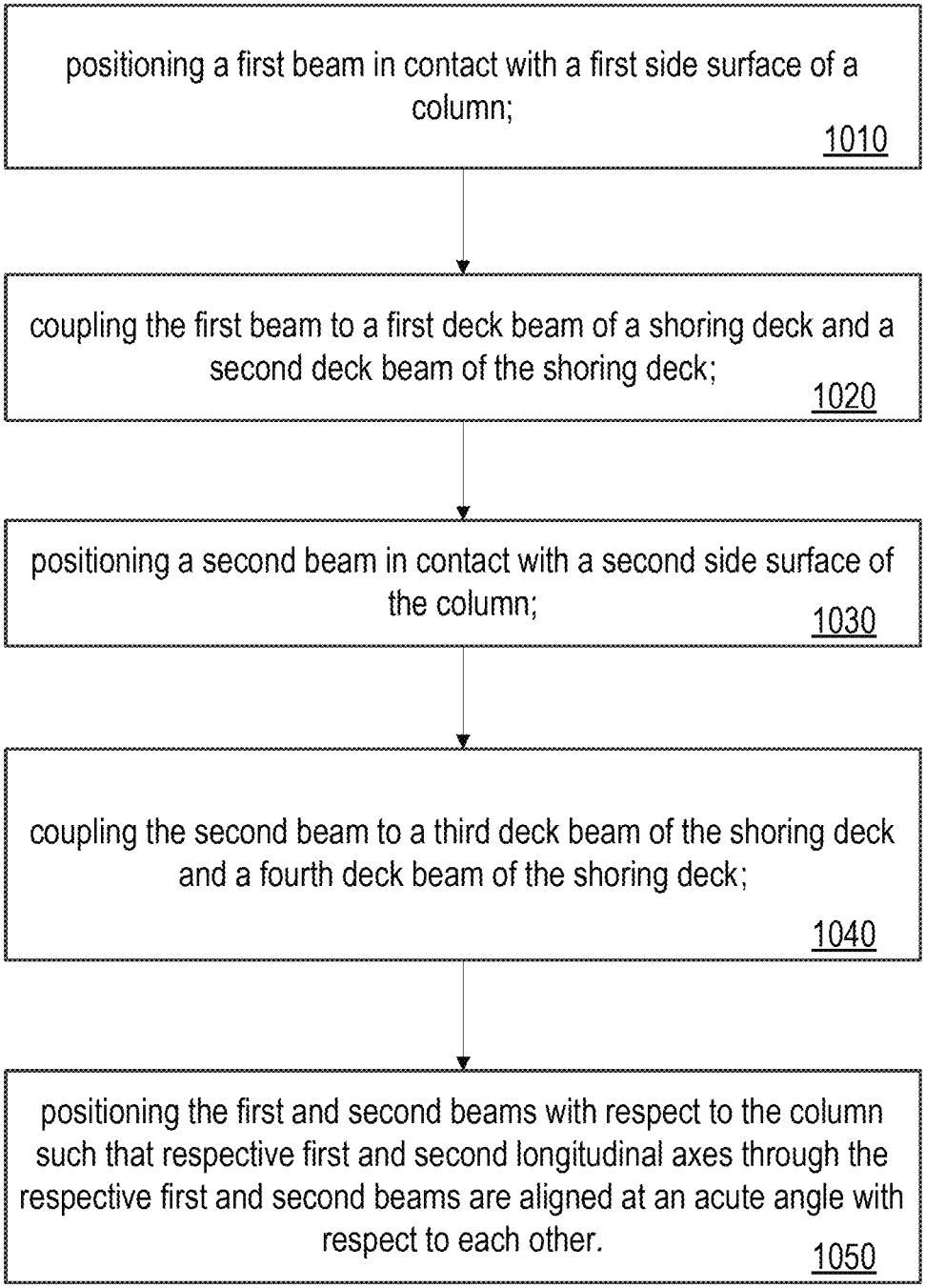
FIG. 10 is a flow diagram of another method for securing a shoring deck to a column.

In another embodiment, a method for securing a shoring deck to a column is shown in FIG. 10. The method includes step 1110: positioning a first beam in contact with a first side surface of a column; step 1120: coupling the first beam to a first deck beam of a shoring deck and a second deck beam of the shoring deck; step 1130: positioning a second beam in contact with a second side surface of the column; step 1140: coupling the second beam to a third deck beam of the shoring deck and a fourth deck beam of the shoring deck; and step 1150: positioning the first and second beams with respect to the column such that respective first and second longitudinal axes through the respective first and second beams are aligned at an acute angle with respect to each other.

While the particular invention has been described with reference to illustrative embodiments, this description is not meant to be limiting. Various modifications of the illustrative embodiments and additional embodiments of the invention will be apparent to one of ordinary skill in the art from this description. Those skilled in the art will readily recognize that these and various other modifications can be made to the exemplary embodiments, illustrated and described herein, without departing from the spirit and scope of the present invention. It is therefore contemplated that the appended claims will cover any such modifications and alternate embodiments. Certain proportions within the illustrations may be exaggerated, while other proportions may be minimized. Accordingly, the disclosure and the figures are to be regarded as illustrative rather than restrictive.

The invention claime is:

1. A method for securing a shoring deck to a column, the method comprising:

positioning a first beam in contact with a first side surface of a column;

coupling the first beam to a first deck beam of a shoring deck and a second deck beam of the shoring deck;

positioning a second beam in contact with a second side surface of the column;

coupling the second beam to a third deck beam of the shoring deck and a fourth deck beam of the shoring deck; and positioning the first and second beams with respect to the column such that respective first and second longitudinal axes through the respective first and second beams are aligned at an acute angle with respect to each other.

2. The method according to claim 1, wherein the first side surface of the column is a planar surface and the second side surface of the column is an edge of the column.

3. The method according to claim 1, wherein:

the first side surface of the column is a first edge of the column; and the second side surface of the column is a second edge of the column, wherein the second edge is an opposite edge from the first edge of the column.

4. The method according to claim 1, wherein the acute angle between the first beam and the second beam is within a range of between about 15 degrees and about 75 degrees.

5. The method of claim 4, wherein the acute angle between the first beam and the second beam is about 45 degrees.

6. The method according to claim 1, wherein the second deck beam and the third deck beam are a same deck beam of the shoring deck.

7. The method according to claim 1, wherein the first beam is a metal angle with a plurality of pre-punched holes.

8. The method according to claim 1, further comprising:

coupling the first beam to the first deck beam by a first bolt; and coupling the second beam to the second deck beam by a second bolt.

9. The method according to claim 1, wherein the second beam is a wood member.

10. The method according to claim 1, further comprising:

coupling the second beam to the third deck beam by a first clamp; and coupling the second beam to the fourth deck beam by a second clamp.

11. The method according to claim 10, wherein the first clamp comprises:

a first arm and a second arm being opposite to each other and connected by a central member, wherein the first and second arms each comprise inwardly extending fingers disposed upon ends opposite to the central member;

a first slot defined in the first arm;

a second slot defined in the second arm; and a wedge configured to extend through the first slot and the second slot to mechanically couple the second beam to the third deck beam by compressing the second beam and the third deck beam together by urging the wedge further through the first and second slots, wherein the extending fingers of the first and second arms rest upon a surface of the third deck beam and the second beam is positioned between the wedge and third deck beam.

12. The method of claim 11, wherein the first and second arms hang from the third deck beam.

13. The method of claim 1, wherein the first beam aligned such that the first longitudinal axis is perpendicular to a longitudinal axis of the column.

14. The method of claim 1, wherein the first and second beams are each disposed such that both of the first and second longitudinal axes are perpendicular to a longitudinal axis of the column.

15. The method of claim 1, wherein one or both of the first and second longitudinal axes are disposed an oblique angle with respect to a longitudinal axis of the column.

16. The method according to claim 1, the method further comprising:

providing a third beam in contact with a third side surface of the column;

coupling the third beam to the second deck beam and the fourth deck beam; and positioning the first and third beam with respect to the column such that respective first and third longitudinal axes through the respective first and third beams are aligned at an acute angle with respect to each other.

17. A method for securing a shoring deck with a plurality of deck beams to a column, the method comprising:

providing a first beam bracing against a column;

coupling the first beam to a first deck beam of a plurality of deck beams of a shoring deck and a second deck beam of the plurality of deck beams of the shoring deck;

providing a second beam bracing against the column the second beam extending along a longitudinal axis;

coupling the second beam to a third deck beam of the plurality of deck beams of the shoring deck and a fourth deck beam of the plurality of deck beams of the shoring deck; and positioning the first and second beams with respect to the column such that respective longitudinal axes of the first and second beams are aligned at an acute angle with respect to each other.

18. The method according to claim 17, wherein the step of providing the first beam bracing against the column comprises:

providing the first beam bracing against a side surface of the column.

19. The method according to claim 17, wherein the step of providing the first beam bracing against the column comprises:

providing the first beam bracing against a first corner of the column.

20. The method according to claim 19 , wherein the step of providing the second beam bracing against the column comprises:

providing the second beam bracing against a second corner of the column, wherein the second corner is an opposite corner from the first corner of the column.

21. The method according to claim 18, wherein the step of providing the second bracing against the column comprises:

providing the second beam bracing against a first corner of the column, that is opposite from the first surface of the column.

22. The method according to claim 17, wherein the acute angle between the first beam and the second beam is within a range of about 30 degrees to about 60 degrees.

23. The method according to claim 17, wherein the second deck beam and the third deck beam are a same deck beam of the plurality of deck beams of the shoring deck.

24. The method according to claim 17, wherein the first beam is a metal angle with a plurality of pre-punched holes.

25. The method according to claim 24, wherein the step of coupling the first beam to the first deck beam of the shoring deck and the second deck beam of the shoring deck comprises:

coupling the first beam to the first deck beam by a first bolt; and coupling the first beam to the second deck beam by a second bolt.

26. The method according to claim 17, wherein the second beam is a wood member.

27. The method according to claim 17, wherein the step of coupling the second beam to the third deck beam of the shoring deck and the fourth deck beam of the shoring deck comprises:

coupling the second beam to the third deck beam by a first clamp;

coupling the second beam to the deck beam by a second clamp.

28. The method according to claim 26, wherein the first clamp comprises:

a first arm and a second arm being opposite to each other and connected by a central member, wherein the first and second arms each comprise inwardly extending fingers disposed upon ends opposite to the central member;

a first slot defined in the first arm;

a second slot defined in the second arm; and a wedge configured to extend through the first slot and the second slot to mechanically couple the second beam to the third deck beam by compressing the second beam and the third deck beam together by urging the wedge further through the first and second slots, wherein the extending fingers of the first and second arms rest upon a surface of the third deck beam and the second beam is positioned between the wedge and third deck beam.

29. The method of claim 28, wherein the first and second arms hang from the third deck beam.

30. The method according to claim 17, the method further comprising:

providing a third beam bracing against the column;

coupling the third beam to the second deck beam and the fourth deck beam; and positioning the first and third beam with respect to the column such that respective first and third longitudinal axes through the respective first and third beams are aligned at an acute angle with respect to each other.

31. The method of claim 17, wherein, wherein the first beam is disposed such that a longitudinal axis of the first beam is perpendicular to an axis of the column.

* * * * *